United States Patent [19]

Lundqvist

[11] 4,157,616

[45] Jun. 12, 1979

[54] HAND TOOLS

[76] Inventor: Karl G. Lundqvist, Molinsgatan 4, Göteborg, Sweden, 411 33

[21] Appl. No.: 862,548

[22] Filed: Dec. 20, 1977

[51] Int. Cl.[2] ..... B26B 29/02

[52] U.S. Cl. ..... 30/153; 30/298; 294/25

[58] Field of Search ..... 30/286, 164.7, 153, 30/298; 294/25, 26

[56] References Cited

U.S. PATENT DOCUMENTS

| | | | |
|---|---|---|---|
| 3,781,988 | 1/1974 | Jones | 30/286 |
| 4,087,911 | 5/1978 | Schrock | 30/153 |

FOREIGN PATENT DOCUMENTS

| | | | |
|---|---|---|---|
| 64987 | 10/1892 | Fed. Rep. of Germany | 30/153 |

*Primary Examiner*—Jimmy C. Peters

*Attorney, Agent, or Firm*—Plumley and Tyner

[57] ABSTRACT

A hand tool of the kind comprising a pointed edge or blade, and a cover protecting the latter in the non-operative position thereof but intended to be swung away to expose the point in the operative position of the tool. Means are arranged to lock the cover to prevent it from being inadvertently moved to the point-exposing position but to allow the cover to be swung away readily to expose the point by using one hand only, when the point is to be used.

2 Claims, 4 Drawing Figures

HAND TOOLS

BACKGROUND OF THE INVENTION

The subject invention relates to a device in hand tools of the kind that are provided with a sharp or pointed member, such as the blade of a knife or a spike, and with a cover enclosing the sharp or pointed member and being pivotally secured thereto, whereby the cover may be swung from a position wherein it protects said member to a position exposing said member.

Prior-art devices of this kind are often designed in such a manner that the cover swinging movement may be effected too easily. As a result, the sharp member, e.g. the blade of a knife may be unprotected by the cover, also when the sharp member is in its inactive position.

To prevent as far as possible this situation from arising, one prior-art cover enclosing sharp or pointed members is provided with a locking mechanism allowing the cover swinging movement only after displacement of the cover in a particular way. However, prior-art locking mechanisms for this purpose are constructed in such a manner that both hands must be used to effect the swinging movement of the cover.

SUMMARY OF THE INVENTION

The purpose of the subject invention is to allow easier manipulation of a cover that protects the sharp or pointed member of a hand tool. This purpose is achieved in accordance with the invention in that the swinging movement of the cover from its protecting position is made possible only after the cover has been displaced from a locked position in a direction inwards, towards the sharp or pointed member at right angles to the pivot axis of the cover. Owing to this arrangement, the cover is retained safely in position enclosing the sharp or pointed member while at the same time it becomes possible to effect the swinging movement of the cover away from the tool by using only the same hand as holds the tool.

BRIEF DESCRIPTION OF THE DRAWINGS

The invention will be described in closer detail in the following with reference to a preferred embodiment illustrated in the accompanying drawings, wherein.

DETAILED DESCRIPTION OF A PREFERRED EMBODIMENT

Figure 1:
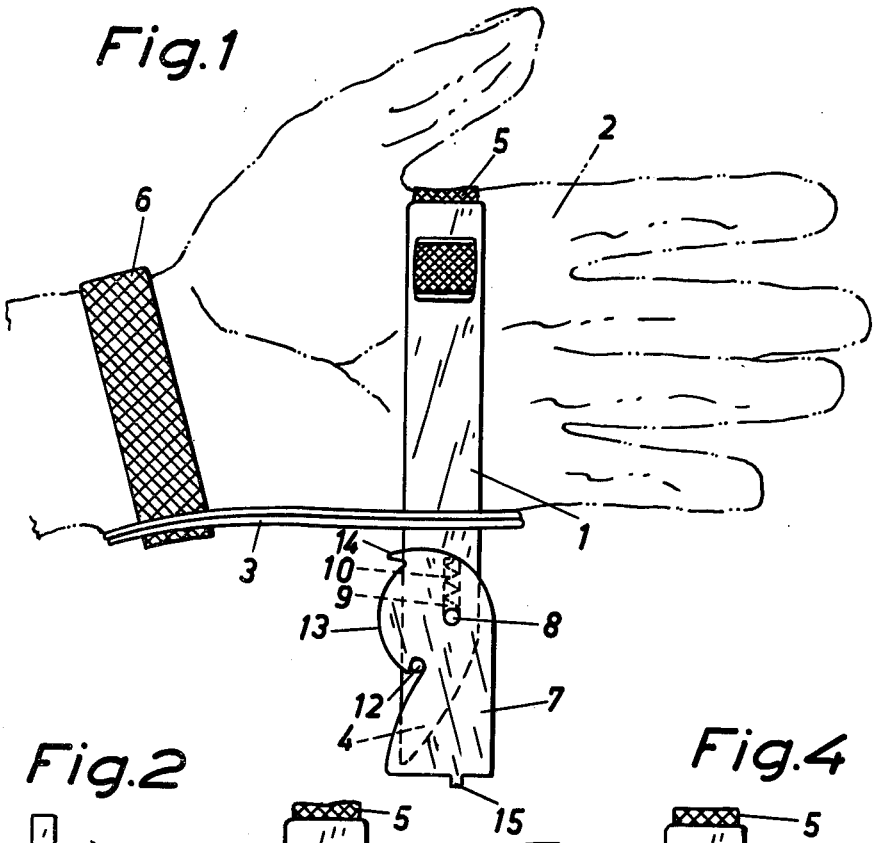
FIG. 1 is a side view of a hand on which is attached the tool according to the embodiment of the invention.
Figure 2:
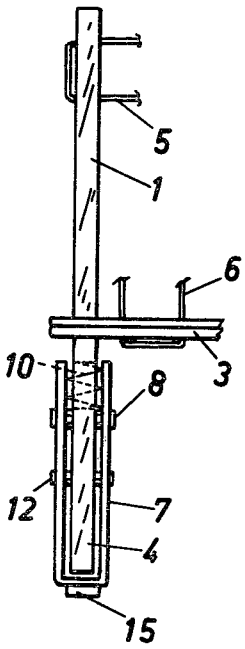
FIG. 2 is a view of this tool as seen from the right in FIG. 1.

To illustrate one application of the inventive object has been chosen the embodiment thereof when it is used as an ice spike intended to be attached to the hand. The spike tool consists of a handle portion 1 which projects through a support rail 3 extending along the little finger side of the hand 2 in abutting relationship therewith, and which below this rail merges into a chisel-like spike 4. Tightening belts 5 and 6 secure the spike tool to respectively the palm and the wrist of the hand.

So as to enclose the spike 4 proper, a cover 7 is provided which is pivotally connected to the spike. The cover 7 is arranged to turn about a pivot shaft 8 from a position wherein it encloses the spike 4 to a position exposing the latter. In accordance with the invention, the swinging movement of the cover is possible only after displacement of the cover 7 from a locked position in a direction inwards, towards the spike 4, at right angles to the pivot shaft 8 of the cover. This shaft is rigidly secured to the cover and passes freely through an elongated notch or aperture 9 formed in the spike 4. The notch houses a compression spring 10 which in its neutral position (FIG. 1) is somewhat biased so as to exert a pressure on the pivot shaft 8.

The cover 7 is further provided with a marginal notch 11 which, in the locked position of the cover (FIG. 1), partly surrounds and engages a catch pin 12 projecting from the spike 4.

The cover 7 is formed with a curved edge 13 connecting up with the marginal notch 11. At the end of the curved edge 13 opposite the notch 11, the cover 7 is provided with a stop shoulder 14 arranged, upon movement of the cover to its swung-away position, to be displaced into abutment against the catch pin 12 and thus prevent further movement of the cover in the same direction.

Finally, the cover 7 is provided at its lower edge with a gripping edge 15, preferably in the form of a projection punched from the cover and arranged, when the cover is pressed against a support 16 (see FIG. 3), to facilitate the outwards swinging movement of the cover.

Figure 3:
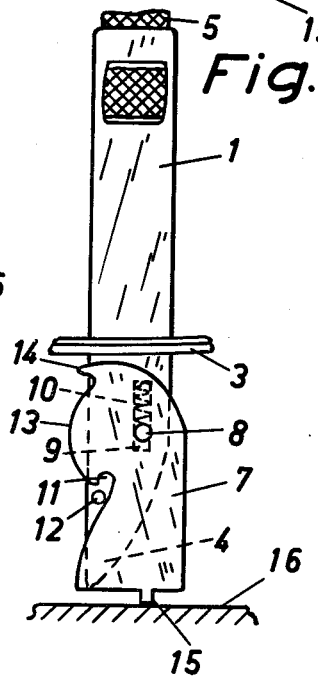
FIG. 3 is a lateral view of the tool showing the cover thereof having been forced out of its locked position.
Figure 4:
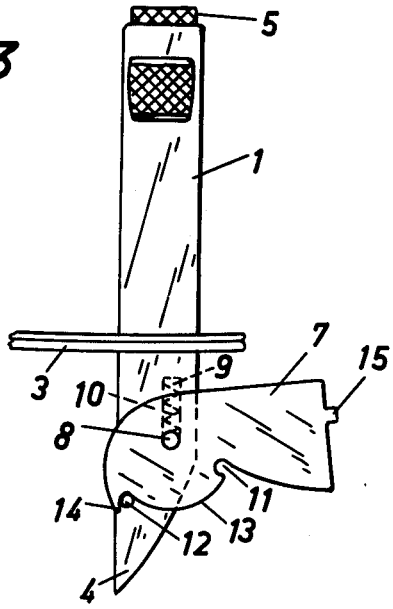
FIG. 4 is a view of the tool showing the cover in its swung-away position, exposing the sharp or pointed member.

As illustrated in FIG. 1, the cover 7 is retained safely in the locked position wherein it protectingly encloses the spike 4, also if it were to receive inadvertently impacts from the front, the rear or in the transverse direction. In the event that use of the spike 4 is urgently required, as could very well be the case with ice spike tools of the kind shown as an example in the drawings, the user of the tool presses the latter straight downwards against a support (the ice) in the manner shown in FIG. 3. As a result of this pressing-down of the tool, the cover 7 will be forced upwards relative to the spike 4 against the action of the compression spring 10 over a sufficient distance to ensure that the marginal notch 11 is moved out of its engagement with the catch pin 12. By lightly pulling the spike tool to the left as seen in FIG. 3, the user then brings about the outwards swinging movement of the cover 7, during which the curved edge 13 slides along the catch pin 12. The curvature of the edge 13 and the position of the catch pin 12 in relation to the pivot shaft 8 of the cover are chosen to ensure that over the major portion of its swinging movement the cover 7 will be forced to perform its movement as a result of the force by which the compression spring 10 presses against the pivot shaft of the cover. As soon as the cover has reached its extreme outer position (see FIG. 4), the stop shoulder 14 prevents the cover from moving further in the same direction, thus facilitating return of the cover to the locked position thereof. In this position, and particularly in the case of ice spike tools, the cover also serves to protect the finger knuckles as the tool is dug into e.g. ice.

The invention is not limited to the embodiment as shown and illustrated but several modifications are possible within the scope of the appended claims. For instance, the cover 7 may be designed in a different manner and the compression spring 10 may be replaced by a traction spring, inserted between the support rail 3 and the cover.

It should be understood without further that the device in accordance with the invention is applicable also to other tools, such as knives, awls, and the like.

What I claim is:

1. An improvement in hand tools of the kind comprising a sharp or pointed member, (such as the blade of a knife, or a spike) and a cover enclosing and pivotally connected to said sharp or pointed member and arranged to be swung outwards from a position wherein it protects said sharp or pointed member to position wherein it exposes said member, the improvement comprising a pivot shaft on said sharp or pointed member rigidly connected to said cover, an elongated aperture formed in said sharp or pointed member, said pivot shaft passing freely through said aperture, a compression spring inserted in said aperture, one end of said spring abutting against said pivot shaft, means being provided to lock said cover in its protective position said cover arranged to be displaced from said protective position only after having been displaced from the locked position in a direction inwards, towards said sharp or pointed member, at right angles to said pivot shaft of said cover.

2. An improvement as claimed in claim 1, comprising a grippping edge formed on said cover, said gripping edge arranged, when said cover is pressed against a support for the purpose of being swung outwards, to facilitate said outwards swinging movement of said cover.

* * * * *